US007858556B2

(12) United States Patent
Takehara et al.

(10) Patent No.: US 7,858,556 B2
(45) **Date of Patent: *Dec. 28, 2010**

(54) HEAT-SENSITIVE TRANSFER IMAGE-RECEIVING SHEET

(75) Inventors: Hiroshi Takehara, Kanagawa (JP); Tomoyuki Koide, Kanagawa (JP); Yoshihisa Tsukada, Kanagawa (JP); Yoshio Ishii, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 837 days.

This patent is subject to a terminal disclaimer.

(21) Appl. No.: 11/711,679

(22) Filed: Feb. 28, 2007

(65) Prior Publication Data

US 2007/0203024 A1 Aug. 30, 2007

(30) Foreign Application Priority Data

Feb. 28, 2006 (JP) ..... 2006-051696

(51) Int. Cl.
*B41M 5/035* (2006.01)
*B41M 5/42* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS

| | | | | |
|---|---|---|---|---|
| 5,073,533 | A * | 12/1991 | Aono | 503/227 |
| 7,381,685 | B2 * | 6/2008 | Oguma et al. | 503/227 |
| 7,485,402 | B2 * | 2/2009 | Arai et al. | 430/201 |

FOREIGN PATENT DOCUMENTS

| | | | |
|---|---|---|---|
| JP | H01-263081 | A | 10/1989 |
| JP | 2-89690 | A | 3/1990 |
| JP | H05-286263 | A | 2/1993 |
| JP | H06-171240 | A | 6/1994 |
| JP | H06-340182 | A | 12/1994 |
| JP | H07-017149 | A | 1/1995 |
| JP | 11-321128 | * | 11/1999 |
| JP | 11-321128 | A | 11/1999 |
| JP | 2000-185475 | A | 4/2000 |
| JP | 2004-175071 | A | 6/2004 |

* cited by examiner

*Primary Examiner*—Bruce H Hess
(74) *Attorney, Agent, or Firm*—Sughrue Mion, PLLC

(57) ABSTRACT

A heat-sensitive transfer image-receiving sheet comprising at least one heat insulating layer containing a hollow polymer and at least one receiving layer containing a polymer latex on a support in this order wherein the support comprises raw paper and a polyolefin resin layer provided on the receiving layer side of the raw paper or on the both sides thereof.

15 Claims, No Drawings

HEAT-SENSITIVE TRANSFER IMAGE-RECEIVING SHEET

BACKGROUND OF THE INVENTION

1. Field of the Invention

The present invention relates to a heat-sensitive transfer image-receiving sheet and more particularly to a heat-sensitive transfer image-receiving sheet for providing a good image having a high transfer density and little image unevenness.

2. Description of the Related Art

Various heat-sensitive transfer recording methods have been heretofore known. In particular, a dye dispersion transfer recording method has been noted as a process capable of preparing a color hard copy having the closest image quality to silver salt photograph (see the non-patent references below). Further, this dye dispersion transfer recording method is advantageous in that it can be operated in a dry process as compared with silver salt photography and allows direct visualization from digital data that facilitates reproduction.

In the dye dispersion transfer recording method, a heat-sensitive transfer sheet containing a dye (hereinafter referred to as "ink sheet") and a heat-sensitive transfer image-receiving sheet (hereinafter referred to as "image-receiving sheet") are laminated on each other. Subsequently, the ink sheet is heated by a thermal head which is controlled in heat generation by an electric signal so that the dye in the ink sheet is transferred to the image-receiving sheet to make recording of image data. Cyan, magenta and yellow colors are then recorded imposed on each other to make transfer recording of a color image having a continuous color density change.

The image-receiving sheet to be used in this process comprises a receiving layer formed on a support for receiving a dye which has been transferred. In general, in order to enhance the adhesion between the image-receiving sheet and the ink sheet, a layer having a high cushioning effect such as foaming layer made of a resin and a foaming agent and a porous layer containing a hollow polymer is formed between the support and the receiving layer (see JP-A-11-321128 and JP-A-2-89690).

For example, "Joho Kiroku (haado kopi) to sono zairyouno shintenkai (New Development of Data Recording (hard copy) and Its Materials)", Toray Research Center, 1993, pp. 241-285 discloses that the spreading and drying of an interlayer comprising a hollow particulate material and an organic solvent-resistant polymer as main components on a support is followed by the formation of a receiving layer by an organic solvent-based resin coating solution. The organic solvent-resistant polymer to be incorporated in the interlayer acts to prevent the hollow particulate material incorporated in the interlayer from being dissolved in the organic solvent in the receiving layer. However, the heat-sensitive transfer image-receiving sheet comprising a receiving layer formed by an organic solvent-based resin coating solution is disadvantageous in that it has an insufficient sensitivity and a raised cost. The heat-sensitive transfer image-receiving sheet has been desired to have improvement also in image quality and transfer density.

"Purinta Zairyou no Kaihatsu (Development of Printer Materials)", CMC, 1995, page 180 discloses a heat-sensitive transfer image-receiving sheet comprising a layer having a hollow spherical pigment dispersed therein and an image-receiving layer (receiving layer). However, this heat-sensitive transfer image-receiving sheet is disadvantageous in that the image obtained after transfer undergoes bleeding.

SUMMARY OF THE INVENTION

It is therefore an object of the invention to provide a heat-sensitive transfer image-receiving sheet having a high transfer density and little image defects at a reduced cost.

The inventors made extensive studies. As a result, it was found that when a support having a polyolefin resin layer provided on the both side of raw paper or at least on the receiving layer side thereof is used and a heat insulating layer containing a hollow polymer is formed on the support, a heat-sensitive transfer image-receiving sheet having a high transfer density and little image defects can be provided at a reduced cost. The present invention has been worked out on the aforementioned knowledge.

In other words, the aforementioned problem can be solved by the following constitutions.

(1) A heat-sensitive transfer image-receiving sheet comprising at least one heat insulating layer containing a hollow polymer and at least one receiving layer containing a polymer latex on a support in this order wherein the support comprises raw paper and a polyolefin resin layer provided on the receiving layer side of the raw paper or on the both sides thereof.

(2) The heat-sensitive transfer image-receiving sheet as defined in Clause (1), wherein the support exhibits a Beck smoothness of 10,000 seconds or more and a central line average roughness (Ra) of 0.5 μm or less on the receiving layer side thereof.

The heat-sensitive transfer image-receiving sheet of the present invention is characterized by a high transfer density and little image defects. In accordance with the present invention, a heat-sensitive transfer image-receiving sheet capable of giving a high quality image having a gloss can be easily provided.

BEST MODE FOR CARRYING OUT THE INVENTION

The heat-sensitive transfer image-receiving sheet of the present invention will be further described hereinafter. The following description of the constituent requirements is occasionally made on the basis of representative embodiments of the present invention, but the present invention is not limited thereto. The numerical range represented by the term " to " include the numerical values set forth before and after "to" as lower and upper limits, respectively.

(Layer Configuration of Heat-Sensitive Transfer Image-Receiving Sheet)

The heat-sensitive transfer image-receiving sheet of the present invention comprises at least one receiving layer (dye receiving layer) provided on a support and at least one heat insulating layer (porous layer) provided between the support and the receiving layer. An underlayer such as whiteness adjusting layer, charge adjusting layer, adhesive layer and primer layer may be provided between the receiving layer and the heat insulating layer. The receiving layer is preferably provided on the top of the support.

The receiving layer and the heat insulating layer are preferably formed by a simultaneous multi-layer coating method. In the case where the underlayer is included, the receiving layer, the underlayer and the heat insulating layer may be formed by a simultaneous multi-layer coating method.

(Receiving Layer)

The receiving layer acts to receive dyes which have moved from the ink sheet and maintain the image thus formed. In the image-receiving sheet of the present invention, the receiving layer contains a polymer latex. The receiving layer may be composed of a single layer or two or more layers. The receiving layer preferably contains a water-soluble polymer described later.

<Polymer Latex>

The polymer latex to be used in the present invention will be further described below. In the heat-sensitive transfer image-receiving sheet of the present invention, the polymer latex to be incorporated in the receiving layer is a dispersion of a water-insoluble hydrophobic polymer in a water-soluble medium as particulate material. Referring to the state of dispersion, the particulate polymer may be emulsified, emulsion-polymerized or micelle-dispersed in the dispersion medium. Alternatively, the polymer molecule may have a partial hydrophilic structure so that the molecular chain itself is molecularly dispersed. For the details of polymer latexes to be used herein, reference can be made to Taira Okuda and Hiroshi Inagaki, "Gousei Jushi Emarujon (Synthetic Resin Emulsion)", Kobunshi Kankoukai, 1978, Takaaki Sugimura, Haruo Kataoka, Soichi Suzuki, Keiji Kasaharam "Gosei Ratekkusu no Oyo (Application of Synthetic Latexes)", Kobunshi Kankoukai, 1993, Soichi Muroi, "Gosei Ratekkusu no Kagaku (Chemistry of Synthetic Latexes)", Kobunshi Kankoukai, 1970, Yoshiaki Miyosawa, "Suisei Kotingu Zairyo no Kaihatsu to Oyo (Development and Application of Aqueous Coating Materials)", CMC, 2004, JP-A-64-538, etc. The average particle size of the dispersed particles is preferably from about 1 nm to 50,000 nm, more preferably from about 5 nm to 1,000 nm.

The distribution of particle size of dispersed particles is not specifically limited. The dispersed particles may have a broad particle size distribution or a monodisperse particle size distribution.

The polymer latex may be one other than polymer latex having an ordinary uniform structure, i.e., so-called core/shell latex. In this structure, the core and the shell may have different glass transition temperatures to advantage. The glass transition temperature of the polymer latex of the present invention is preferably from −30° C. to 100° C., more preferably from 0° C. to 80° C., more preferably from 10° C. to 70° C., particularly preferably from 15° C. to 60° C.

Preferred embodiments of the polymer latex to be used in the present invention include hydrophobic polymers such as acrylic polymer, polyester, rubber (e.g., SBR resin), polyurethane, polyvinyl chloride, polyvinyl acetate, polyvinylidene chloride and polyolefin. These polymers may be straight-chain polymers, branched polymers, crosslinked polymers, so-called homopolymers obtained by polymerization of single monomer or copolymers obtained by polymerization of two or more monomers. In the case where the polymers are copolymers, they may be random copolymers or block copolymers. These copolymers each have a number-average molecular weight of from 5,000 to 1,000,000, preferably from 10,000 to 500,000. When the molecular weight of these copolymers is too small, the dynamic strength of the layer containing the polymer latex is insufficient. On the other hand, when the molecular weight of these copolymers is too great, the polymer latex has deteriorated film-forming properties to disadvantage. Further, crosslinkable polymer latexes are preferably used.

The monomers to be used in the synthesis of the polymer latex to be used in the present invention are not specifically limited. As monomers which can be polymerized by ordinary radical polymerization or ionic polymerization method there can be preferably used the following monomer groups (a) to (j). These monomers can be independently and freely combined to synthesize polymer latexes.

—Monomer Group (a) to (j)—

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene (b) Olefins: ethylene, propylene, vinyl chloride, vinylidene chloride, 6-hydroxy-1-hexene, 4-pentenic acid, methyl 8-nonenate, vinylsulfonic acid, timethylvinyl silane, trimethoxyvinyl silane, 1,4-divinylcyclohexane, 1,2,5-trivinylcyclohexane (c) α,β-Unsaturated carboxylic acid esters: alkyl acrylate (e.g., methyl acrylate, ethyl acrylate, butyl acrylate, cyclohexyl acrylate, 2-ethylhexyl acrylate, dodecyl acrylate), substituted alkyl acrylate (e.g., 2-chloroethyl acrylate, benzyl acrylate, 2-cyanoethyl acrylate), alkyl methacrylate (e.g., methyl methacrylate, butyl methacrylate, 2-ethylhexyl methacrylate, dodecyl methacrylate), substituted alkyl methacrylate (e.g., 2-hydroxyethyl methacrylate, glycidyl methacrylate, glycerin monomethacrylate, 2-acetoxyethyl methacrylate, tetrahydrofurfuryl methacrylate, 2-methoxyethyl methacylate, polypropylene glycol monomethacrylate (number of added moles of polyoxypropylene: 2 to 100), 3-N,N-dimethyl aminopropyl methacrylate, chloro-3-N,N,N-trimethyl ammonoisopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, 2-isocyanatoethyl methacrylate), unsaturated dicarboxylic acid derivative (e.g. monobutyl maleate, dimethyl maleate, monomethyl itaconate, dibutyl itaconate), multifunctional esters (e.g., ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, 1,2,4-cyclohexane tetramethacrylate)

(d) β-Unsaturated carboxylic acid amides: acrylamide, methacrylamide, N-methylacrylamide, N,N-dimethylacrylamide, N-methyl-N-hydroxyethyl methacrylamide, N-tert-butylacrylamide, N-tert-octyl methacrylamide, N-cyclohexylacrylamide, N-phenyl acrylamide, N-(2-acetoacetoxyethyl) acrylamide, N-acryloylmorpholine, diacetone acrylamide, diamide itaconate, N-methyl maleimide, 2-acrylamide-methylpropanesulfonic acid, methylene bisacrylamide, dimethacryloylpiperadine (e) Unsaturated nitriles: acrylonitrile, methacrylonitrile (f) Styrenes and derivatives thereof: styrene, vinyltoluene, p-tert-butylstyrene, vinylbenzoic acid, methyl vinylbenzoate, α-methylstyrene, p-chloromethyl styrene, vinylnaphthalene, p-hydroxymethylsyrene, sodium p-styrenesulfonate, potassium p-styrene sulfinate, p-aminomethylstyrene, 1,4-divinylbenzene (g) Vinylethers: methyl vinyl ether, butyl vinyl ether, methoxy ethyl vinyl ether (h) Vinyl esters: vinyl acetate, vinyl propionate, vinyl benzoate, vinyl salicylate, vinyl chloroacetate (i) α,β-Unsaturated carboxylic acids and salts thereof: acrylic acid, methacrylic acid, itaconic acid, maleic acid, sodium acrylate, ammonium methacrylate, potassium itaconate (j) Other polymerizable monomers: N-vinyl imidazole, 4-vinypyridine, N-vinylpyrrolidone, 2-vinyl oxazoline, 2-isopropenyloxazoline, divinylsulfone The polymer latexes to be used herein are commercially available. As these commercially available products there can be used the following polymers. Examples of the acrylic polymers employable herein include Cevian A-4635, 4718 and 4601 (produced by Daicel Polymer Ltd.), Nipol Lx811, 814, 821, 820, 855 (P-17: Tg 36° C.) and 857×2 (P-18: Tg 43° C.) (produced by ZEON CORPORATION), Voncoat R3370 (P-19: Tg 25° C.), 4280 (P-20: Tg 50° C.) (produced by DAINIPPON INK AND CHEMICALS, INCORPORATED), Jurimer ET-410 (P-21: Tg 44° C.) (produced by Nihon Junyaku Co., Ltd.), AE116 (P-22:Tg 50° C.), AE119 (P-23: Tg 55° C.), AE121 (P-24: Tg 58° C.), AE125 (P-25: Tg 60° C.), AE134 (P-26: Tg 48° C.), AE137 (P-27:Tg 48° C.), AE140 (P-28: Tg 53° C.) and AE173 (P-29: Tg 60° C.) (produced by JSR Co., Ltd.), Aron A-104 (P-30: Tg 45° C.) (produced by TOAGOSEI CO., LTD.), NS-600X and NS-620X (produced by TAKAMATSU OIL & FAT CO., LTD.), and Vinyblan 2580, 2583, 2641, 2770, 2770H, 2635, 2886, 5202C and 2706 (produced by NISSIN CHEMICAL INDUSTRY CO., LTD.) (All these compounds are represented by trade name).

Examples of polyesters employable herein include FINETEX ES650, 611, 675 and 850 (produced by DAINIPPON INK AND CHEMICALS, INCORPORATED), WD-size and WMS (produced by Eastman Chemical Co., Ltd.), A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX and NS-282LX (produced by TAKAMATSU OIL & FAT CO., LTD.), Aronmelt PES-1000 Series and PES-2000 Series (produced by TOAGOSEI CO., LTD.), Vylonal MD-1100, MD-1200, MD-1220, MD-1245, MD-1250, MD-1335, MD-1400, MD-1480, MD-1500, MD-1930 and MD-1985 (produced by TOYOBO CO., LTD.), and Sepoljon ES (produced by Sumitomo Seika Chemicals Co., Ltd.) (All these compounds are represented by trade name).

Examples of polyurethanes employable herein include HYDRAN AP10, AP20, AP30, AP40, 101H, Vondic 1320NS and 1610NS (produced by DAINIPPON INK AND CHEMICALS, INCORPORATED), D-1000, D-2000, D-6000, D-4000 and D-9000 (produced by Dainichiseika Color & Chemicals Mfg. Co., Ltd.), NS-155X, NS-310A, NS-310X and NS-311X (produced by TAKAMATSU OIL & FAT CO., LTD.), and Elastron (produced by DAI-ICHI KOGYO SEIYAKU CO., LTD.) (All these compounds are represented by trade name).

Examples of rubbers employable herein include LACSTAR 7310K, 3307B, 4700H and 7132C (produced by DAINIPPON INK AND CHEMICALS, INCORPORATED), and Nipol Lx416, LX410, LX430, LX435, LX110, LX415A, LX438C, 2507H, LX303A, LX407BP Series, V1004 and MH5055 (produced by ZEON CORPORATION) (All these compounds are represented by trade name).

Examples of polyvinyl chlorides employable herein include G351 and G576 (produced by ZEON CORPORATION), and Vinyblan 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938 and 950 (produced by NISSIN CHEMICAL INDUSTRY CO., LTD.) (All these compounds are represented by trade name). Examples of polyvinylidene chlorides employable herein include L502 and L513 (produced by Asahi Kasei Corporation), and D-5071 (produced by DAINIPPON INK AND CHEMICALS, INCORPORATED) (All these compounds are represented by trade name). Examples of polyolefins employable herein include CHEMIPEARL S120, SA100 and V300 (P-40; Tg 80° C.) (produced by Mitsui Petrochemical Co., Ltd.), Voncoat 2830, 2210 and 2960 (produced by DAINIPPON INK AND CHEMICALS, INCORPORATED), and ZAIKTHENE and Sepoljon G (produced by Sumitomo Seika Chemicals Co., Ltd.). Examples of copolymerized nylons employable herein include Sepoljon PA (produced by Sumitomo Seika Chemicals Co., Ltd.) (All these compounds are represented by trade name).

Examples of polyvinyl acetates employable herein include Vinyblan 1080, 1082, 1085W, 1108W, 1108S, 1563M, 1566, 1570, 1588C, A22J7-F2, 1128C, 1137, 1138, A20J2, A23J1, A23J1, A23K1, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W and 4468S (produced by NISSIN CHEMICAL INDUSTRY CO., LTD.) (All these compounds are represented by trade name).

Polymer latex used in the present invention preferably comprises polyvinyl chloride, more preferably a copolymer of vinyl chloride and acrylic ester, still more preferably a copolymer of vinyl chloride and acrylic ester having a grass transition temperature (Tg) of 30° C. to 80° C.

These polymer latexes may be used singly or in a blend of two or more thereof.

In the present invention, the receiving layer is preferably prepared by spreading an aqueous coating solution, and then drying the coat. The term "aqueous" as used herein is meant to indicate that 60% by mass or more of the solvent (dispersant) in the coating solution is composed of water. Examples of components of the coating solution other than water include water-miscible organic solvents such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether and oxyethylphenyl ether.

The lowest film-forming temperature (MFT) of the polymer latex is preferably from about −30° C. to 90° C., more preferably from about 0° C. to 70° C. In order to control the lowest film-forming temperature of the polymer latex, the polymer latex may comprise a film-forming aid incorporated therein. The film-forming aid is also called a temporary plasticizer and is an organic compound (normally in the form of organic solvent) which lowers the lowest film-forming temperature of the polymer latex. The film-forming aid is described in, e.g., Soichi Muroi, "Gosei Ratekkusu no Kagaku (chemistry of Synthetic Latexes)", Kobunshi Kankokai, 1970. Preferred examples of the film-forming aid include the following compounds, but the compounds employable herein are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

Preferred examples of the polymer latexes employable herein include polyacetic acid esters, polyurethanes, polycarbonates, polyesters, polyacetals, SBR, and polyvinyl chlorides. Most desirable among these polymer latexes are polyesters, polycarbonates, and polyvinyl chlorides.

In the present invention, the aforementioned polymer latex may be used in combination with any polymers so far as the effect of the present cannot be excessively impaired. The polymers which can be used in combination herein are preferably transparent or semitransparent and colorless. Examples of these polymers include natural resins, polymers and copolymers, synthetic polymers and copolymers, and other film-forming media, e.g., gelatins, polyvinyl alcohols, hydroxyethyl celluloses, cellulose acetates, cellulose acetate butyrates, polyvinylpyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinyl chlorides, polyepoxides, polycarbonates, polyvinyl acetates, polyolefins, polyamides. The binder film may be formed from water, organic solvent or emulsion.

The binder to be used in the present invention preferably exhibits a glass transition temperature (Tg) of from −30° C. to 70° C., more preferably from −10° C. to 50° C., even more preferably from 0° C. to 40° C. from the standpoint of work brittleness and image storage properties. As the binder there may be used a blend of two or more polymers. In this case, Tg obtained by weighted-averaging Tg of the various polymers taking into account the composition preferably falls within the above defined range. In the case where phase separation occurs or the binder has a core-shell structure, weighted-averaged Tg preferably falls within the above defined range.

The glass transition temperature (Tg) can be calculated by the following formula.

$$1/Tg=\Sigma(Xi/Tgi)$$

wherein the polymer is obtained by the copolymerization of monomer components in a number of n (i=1 to n). Xi represents the mass fraction of i-th monomer (ΣXi=1). Tgi represents the glass transition temperature (absolute temperature) of homopolymer of i-th monomer. Σ represents the sum of (Xi/Tgi) from i of 1 to n. For the glass transition temperature (Tgi) of homopolymer of the various monomers, reference can be made to J. Brandrup, E. H. Immergut, "Polymer Handbook (3rd Edition)", Wiley-Interscience, 1989.

The polymer to be used in the binder of the present invention can be easily obtained by solution polymerization method, suspension polymerization method, emulsion polymerization method, dispersion polymerization method, anionic polymerization method, cationic polymerization method or the like. Most desirable among these polymerization methods is emulsion polymerization because the polymer can be obtained in the form of latex. Also, a method is preferably used which comprises preparing a polymer in a solution, neutralizing the polymer or adding an emulsifier to the polymer, adding water to the polymer, and then forcedly stirring the mixture to prepare an aqueous dispersion. The emulsion polymerization is carried out by allowing a mixture of a dispersing medium such as water or a mixture thereof with a water-miscible organic solvent (e.g., methanol, ethanol, acetone) with a monomer in an amount of from 5% to 150% by mass based on the amount of the dispersing medium to undergo polymerization with stirring in the presence of an emulsifier and a polymerization initiator based on the total amount of the monomers at a temperature of from about 30° C. to 100° C., preferably from 60° C. to 90° C. for 3 to 24 hours. The various conditions such as the kind of dispersant to be used, the monomer concentration, the amount of initiator, the amount of emulsifier, the amount of dispersant, the reaction temperature and the method for adding monomer may be properly predetermined taking into account the kind of the monomers used. It is also preferred that a dispersant be used as necessary.

The emulsion polymerization can be normally carried out by the method disclosed in Taira Okuda and Hiroshi Inagaki, "Gousei Jushi Emarujon (Synthetic Resin Emulsion)", Kobunshi Kankoukai, 1978, Takaaki Sugimura, Haruo Kataoka, Soichi Suzuki, Keiji Kasaharam "Gosei Ratekkusu no Oyo (Application of Synthetic Latexes)", Kobunshi Kankoukai, 1993, Soichi Muroi, "Gosei Ratekkusu no Kagaku (Chemistry of Synthetic Latexes)", Kobunshi Kankoukai, 1970, etc. As the emulsion polymerization method for synthesizing the polymer latex to be used in the present invention there may be selected collective polymerization method, monomer addition (continuous or batchwise) method, emulsion addition method, seed polymerization method, etc. Preferred among these polymerization methods from the standpoint of productivity of latex are collective polymerization method, monomer addition (continuous or batchwise) method and emulsion addition method.

As the aforementioned polymerization initiator there may be used any polymerization initiator capable of generating radicals. Examples of the polymerization initiator employable herein include inorganic peroxides such as persulfate and hydrogen peroxide, peroxides as disclosed in a catalog of organic peroxides published by NOF CORPORATION, and azo compounds as disclosed in a catalog of azo polymerization initiator published by Wako Pure Chemical Industries, Ltd. Preferred among these polymerization initiators are water-soluble peroxides such as persulfate and water-soluble azo compounds as disclosed in a catalog of azo polymerization initiator published by Wako Pure Chemical Industries, Ltd. More desirable among these polymerization initiators are ammonium persulfate, sodium persulfate, potassium persulfate, azobis(2-methylpropionamizine)hydrochloride, azobis(2-methyl-N-(2-hydroxyethyl)propionamide) and azobiscyanovaleric acid. Particularly preferred among these polymerization initiators are persulfates such as ammonium persulfate, sodium persulfate and potassium persulfate from the standpoint of image storage properties, solubility and cost.

The amount of the aforementioned polymerization initiator to be added is preferably from 0.3% to 2.0% by mass, more preferably from 0.4% to 1.75% by mass, particularly preferably from 0.5% to 1.5% by mass based on the total amount of the monomers.

As the aforementioned polymerization emulsifier there may be used any of anionic surface active agents, nonionic surface active agents, cationic surface active agents and amphoteric surface active agents. Preferred among these polymerization emulsifiers are anionic surface active agents from the standpoint of dispersibility and image storage properties. More desirable among these anionic surface active agents are sulfonic acid type anionic surface active agents because they can be used in a small amount to assure polymerization stability and have hydrolyzation resistance. Even more desirable among these sulfonic acid type anionic surface active agents are long-chain alkyldiphenyletherdisulfonic acid such as PELEX SS-H (trade name; produced by Kao Corporation). Particularly desirable are low electrolyte type such as Pionin A-43-S (trade name; produced by TAKEMOTO OIL & FAT Co., Ltd.).

As the aforementioned polymerization emulsifier there is preferably used a sulfonic acid type anionic surface active agent in an amount of from 0.1% to 10.0% by mass, more preferably from 0.2% to 7.5% by mass, particularly preferably from 0.3% to 5.0% by mass based on the total amount of the monomers.

For the synthesis of the polymer latex to be used in the present invention, a chelating gent is preferably used. A chelating agent is a compound capable of chelating polyvalent ions such as metal ion, e.g., ferric or ferrous ion and alkaline earth metal ion, e.g., calcium ion. Examples of the chelating agent employable herein include compounds as disclosed in JP-B-6-8956, U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, JP-A-11-190892, and JP-A-11-190892.

Preferred examples of the aforementioned chelating agents employable herein include inorganic chelate compounds (e.g., sodium tripolyphosphate, sodium hexamethaphosphate, sodium tetrapolyphosphate), aminopolycarboxylic acid-based chelate compounds (e.g., nitrilotriacetic acid, ethylenediaminetetraacetic acid), organic phosphonic acid-based chelate compounds (e.g., compounds disclosed in Research Disclosure No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, West German Patent 1045373), polyphenolic chelating agents, and polyamine-based chelate compounds. Particularly preferred are aminopolycarboxylic acid derivatives.

Preferred examples of the aforementioned aminopolycarboxylic acid derivatives employable herein include compounds set forth in the attached table in "EDTA (-Chemistry of Complexanes)", Nankodo, 1977. Further examples of the aminopolycarboxylic acid derivatives include those obtained by substituting some of carboxylic groups in the above exemplified compounds by salt of alkaline metal such as sodium and potassium or ammonium salt or the like. Particularly preferred examples of the aminopolycarboxylic acid derivative employable herein include iminodiacetic acid, N-methyl iminodiacetic acid, N-(2-aminoethyl)iminodiacetic acid, N-(carbamoylmethyl)iminodiacetic acid, nitrilotriacetic acid, ethylenediamine-N,N'-diacetic acid, ethylenediamine-N,N'-di-α-propionic acid, ethylenediamine-N,N'-di-β-propionic, acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diaceto hydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N'N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetracetic acid, o-phenylenediamine-N,N,N',N'-tetraacetic acid, cis-1,4-diaminobutene-N,N,N',N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-β-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. Further examples of the aminopolycarboxylic acid derivative employable herein include those obtained by substituting some of carboxylic groups in the above exemplified compounds by salt of alkaline metal such as sodium and potassium with ammonium or the like.

The amount of the aforementioned chelating agent to be added is preferably from 0.01% to 0.4% by mass, more preferably from 0.02% to 0.3% by mass, particularly preferably from 0.03% to 0.15% by mass based on the total amount of the monomers. When the amount of the chelating agent to be added falls below 0.01% by mass, the metallic ions which have entered at the step of producing the polymer latex cannot be sufficiently caught, causing the drop of stability of latex to agglomeration and hence the deterioration of spreadability. On the other hand, when the amount of the chelating agent to be added exceeds 0.4% by mass, the resulting latex exhibits a raised viscosity and hence a deteriorated spreadability.

The synthesis of the polymer latex to be used in the present invention is preferably effected in the presence of a chain transfer agent. As such a chain transfer agent there is preferably used one disclosed in "Polymer Handbook, 3rd edition", Wiley-Interscience, 1989. Sulfur compounds are more desirable because they have a high chain transfer capability and thus can be used in a small amount. Particularly desirable are hydrophobic mercaptane-based chain transfer agents such as tert-dodecylmercaptane and n-dodecylmercaptane.

The amount of the aforementioned chain transfer agent to be added is preferably from 0.2% to 2.0% by mass, more preferably from 0.3% to 1.8% by mass, particularly preferably from 0.4% to 1.6% by mass based on the total amount of the monomers.

For the emulsion polymerization, additives as disclosed in handbook of synthetic rubbers such as electrolyte, stabilizer, thickening agent, anti-foaming agent, oxidation inhibitor, vulcanizing agent, antifreezing agent, gelatinizing agent and vulcanization accelerator may be used besides the aforementioned compounds.

As the solvent to be used in the coating solution of the polymer latex of the invention there may be used an aqueous solvent. However, a water-miscible organic solvent may be used in combination with the aqueous solvent. Examples of the water-miscible organic solvent employable herein include alcohol-based solvents such as methyl alcohol, ethyl alcohol and propyl alcohol, cellosolve-based solvents such as methyl cellosolve, ethyl cellosolve and butyl cellosolve, ethyl acetate, and dimethylformamide. The amount of these organic solvents to be added is preferably 50% by mass or less, more preferably 30% by mass or less based on the amount of the solvents.

Referring further to the polymer latex to be used in the present invention, the concentration of polymers in the latex solution is preferably from 10% to 70% by mass, more preferably from 20% to 60% by masse particularly preferably from 30% to 55% by mass.

The polymer latex in the image-receiving sheet of the present invention is partially in the form of gel or dried film formed by drying part of the solvents after spreading.

<Water-Soluble Polymer>

The receiving layer preferably comprises a water-soluble polymer incorporated therein. The water-soluble polymer is defined as a polymer in which the solubility to 100 g of water at 20° C. is at least 0.05 g, preferably at least 0.1 g, more preferably at least 0.5 g. Examples of the water-soluble polymer employable herein include natural polymers (e.g., polysaccharide-based polymers, microorganism-based polymers, animal-based polymers), semisynthetic polymers (e.g., cellulose-based polymers, starch-based polymers, alginic acid-based polymers), and synthetic polymers (e.g., vinyl-based polymers). The synthetic polymers such as polyvinyl alcohol described below and natural or semisynthetic polymers made from plant-derived cellulose correspond to the water-soluble polymers which can be used in the present invention. The water-soluble polymers in the present invention don't include the aforementioned polymer latexes.

Among the water-soluble polymers which can be used in the present invention, the natural polymers and semisynthetic polymers will be further described below. Examples of the plant-based polysaccharides include gum arabic, κ-carrageenan, τ-carrageenan, λ-carrageenan, guar gum (Supercol, produced by Squalon Inc.), locust bean gum, pectine, traganth, corn starch (e.g., Purity-21, produced by National Starch & Chemical Co., Ltd.), and phosphate starch (e.g., 78-1898, produced by National starch & Chemical Co., Ltd.). Examples of the microorganism-based polysaccharides include xanthane gum (e.g., Keltrol T, produced by Kelco Co., Ltd.), and dextrin (e.g., Nadex 360, produced by National Starch & Chemical Co., Ltd.). Examples of the animal-based natural polymers include gelatin (e.g., Crodyne B419, produced by Croda Co., Ltd.), casein, and sodium chondroitinsulfate (e.g., Cromoist CS, produced by Croda Co., Ltd.). (All these compounds are represented by trade name). Examples of the cellulose-based polymers include ethyl cellulose (e.g., Cellofas WLD, produced by I.C.I.), carboxymethyl cellulose (e.g., CMC, produced by Daicel Polymer Ltd.), hydroxyethyl cellulose (e.g., HEC, produced by Daicel Polymer Ltd.), hydroxypropyl cellulose (e.g., Aqualon, produced by Klucel Co., Ltd.), methyl cellulose (e.g., Viscontran, produced by Henkel Co., Ltd.), nitrocellulose (e.g., Isopropyl Wet, produced by Hercules Co., Ltd.), and cationated cellulose (e.g., Crodacel QM, produced by Croda Co., Ltd.). (All these compounds are represented by trade name). Examples of the starch-based polymers include phosphate starch (e.g., National 78-1898, produced by National Starch & Chemical Co., Ltd.). Examples of the alginate-based polymers include sodium alginate (e.g., Keltone, produced by Kelon Co., Ltd.), and propylene glycol alginate. Examples of other groups of polymers include cationated guar gum (e.g., Hi-care 1000, produced by Alcolac Co., Ltd.), and sodium hyaluronate (e.g., Hyalre, produced by Life Biomedical Co., Ltd.) (All these compounds are represented by trade name).

Among the water-soluble polymers which can be used in the present invention, the synthetic polymers will be further described below. Examples of the acrylic polymers employable herein include sodium polyacrylates, polyacrylic acid copolymers, polyacrylamides, polyacrylamide copolymers, and quaternary salts of polydiethylaminoethyl(meth)acrylate and copolymers thereof. Examples of the vinyl-based polymers include polyvinypyrrolidones, polyvinylpyrrolidone copolymers, and polyvinyl alcohols. Other examples of the synthetic polymers include polyethylene glycols, polypropylene glycols, polyisopropyl acrylamides, polymethyl vinyl ethers, polyethyleneimines, polystyrenesulfonic acids, copolymers thereof, naphthalenesulfonic acid condensates, polyvinylsulfonic acids, copolymers thereof, polyacrylic acids, copolymers thereof, acrylic acids, copolymers thereof, maleic acid copolymers, maleic acid monoester copolymers, acryloylmethylpropanesulfonic acids, copolymers thereof, polydimethyldiallylammonium chlorides, copolymers thereof, polyamizines, copolymers thereof, polyimidazolines, dicyaneamide-based condensates, epichlorohydrin-dimethylamine condensates, Hoffman decomposition product of polyacrylamides, and water-soluble polyesters (e.g., Z-221, Z-446, Z-561, Z-450, Z-565, Z-850, Z-3308, RZ-105, RZ-570, Z-730, RZ-142, produced by GOO CHEMICAL CO., LTD.) (All these compounds are represented by trade name).

High hygroscopicity polymers disclosed in U.S. Pat. No. 4,960,681, JP-A-62-245260, etc., i.e., homopolymer of vinyl monomers having —COOM or —$SO_3M$ (in which M represents a hydrogen atom or alkaline metal) or copolymers of these vinyl monomers with each other or with other vinyl monomers (e.g., sodium methacrylate, ammonium methacrylate, Sumicagel L-5H (produced by Sumitomo Chemical Co., Ltd.)) can be used.

Preferred among the water-soluble synthetic polymers which can be used in the present invention are polyvinyl alcohols.

These polyvinyl alcohols will be further described below. Examples of fully-saponified polyvinyl alcohols include PVA-105 [polyvinyl alcohol (PVA) content: 94.0% by mass or more; percent saponification: 98.5±0.5 mol-%; sodium acetate content: 1.5% by mass or less; volatile content: 5.0% by mass or less; viscosity (4% by mass, 20° C.): 5.6±0.4 CPS], PVA-110 [PVA content: 94.0% by mass; percent saponification: 98.5±0.5 mol-%; sodium acetate content: 1.5% by mass; volatile content: 5.0% by mass; viscosity (4% by mass, 20° C.): 11.0±0.8 CPS], PVA-117 [PVA content: 94.0% by mass; percent saponification: 98.5±0.5 mol-%; sodium acetate content: 1.0% by mass; volatile content: 5.0% by mass; viscosity (4% by mass, 20° C.): 28.0±3.0 CPS], PVA-117H [PVA content: 93.5% by mass; percent saponification: 99.6±0.3 mol-%; sodium acetate content: 1.85% by mass; volatile content: 5.0% by mass; viscosity (4% by mass, 20° C.): 29.0±3.0 CPS], PVA-120 [PVA content: 94.0% by mass; percent saponification: 98.5±0.5 mol-%; sodium acetate content: 1.0% by mass; volatile content: 5.0% by mass; viscosity (4% by mass, 20° C.): 39.5±4.5 CPS], PVA-124 [PVA content: 94.0% by mass; percent saponification: 98.5±0.5 mol-%; sodium acetate content: 1.0% by mass; volatile content: 5.0% by mass; viscosity (4% by mass, 20° C.): 60.0±6.0 CPS], PVA-124 [PVA content: 93.5% by mass; percent saponification: 99.6±0.3 mol-%; sodium acetate content: 1.85% by mass; volatile content: 5.0% by mass; viscosity (4% by mass, 20° C.): 61.0±6.0 CPS], PVA-CS [PVA content: 94.0% by mass; percent saponification: 97.5±0.5 mol-%; sodium acetate content: 1.0% by mass; volatile content: 5.0% by mass; viscosity (4% by mass, 20° C.): 27.5±3.0 CPS], PVA-CST [PVA content: 94.0% by mass; percent saponification: 96.0±0.5 mol-%; sodium acetate content: 1.0% by mass; volatile content: 5.0% by mass; viscosity (4% by mass, 20° C.): 27.0±3.0 CPS], and PVA-HC [PVA content: 90.0% by mass; percent saponification: 99.85 mol-% or more; sodium acetate content; 2.5% by mass; volatile content: 8.5% by mass; viscosity (4% by mass, 20° C.): 25.0±3.5 CPS] (All these products are commercially available from KURARAY CO., LTD.).

Examples of partially-saponified polyvinyl alcohols include PVA-203 [PVA content: 94.0% by mass; percent saponification: 88.0±1.5 mol-%; sodium acetate content: 1.0% by mass; volatile content: 5.0% by mass; Viscosity (4% by mass, 20° C.): 3.4±0.2 CPS], PVA-204 [PVA content: 94.0% by mass; percent saponification: 88.0±1.5 mol-%; sodium acetate content: 1.0% by mass; volatile content: 5.0% by mass; viscosity (4% by mass, 20° C.): 3.9±0.3 CPS], PVA-205 [PVA content: 94.0% by mass; percent saponification: 88.0±1.5 mol-%; sodium acetate content: 1.0% by mass; volatile content: 5.0% by mass; viscosity (4% by mass, 20° C.): 5.0±0.4 CPS], PVA-210 [PVA content: 94.0% by mass; percent saponification: 88.0±1.0 mol-%; sodium acetate content: 1.0% by mass; volatile content: 5.0% by mass; viscosity (4% by mass, 20° C.): 9.0±1.0 CPS], PVA-217 [PVA content: 94.0% by mass; percent saponification: 88.0±1.0 mol-%; sodium acetate content: 1.0% by mass; volatile content: 5.0% by mass; viscosity (4% by mass, 20° C.): 22.5±2.0 CPS], PVA-220 [PVA content: 94.0% by mass; percent saponification: 88.0±1.0 mol-%; sodium acetate content: 1.0% by mass; volatile content: 5.0% by mass; viscosity (4% by mass, 20° C.): 30.0±3.0 CPS], PVA-224 [PVA content: 94.0% by mass; percent saponification: 88.0±1.5 mol-%; sodium acetate content: 1.0% by mass; volatile content: 5.0% by mass; viscosity (4% by mass, 20° C.): 44.0±4.0 CPS], PVA-228 [PVA content: 94.0% by mass; percent saponification: 88.0±1.5 mol-%; sodium acetate content: 1.0% by mass; volatile content: 5.0% by mass; viscosity (4% by mass, 20° C.): 65.0±5.0 CPS], PVA-235 [PVA content: 94.0% by mass; percent saponification: 88.0±1.5 mol-%; sodium acetate content: 1.0% by mass; volatile content: 5.0% by mass; viscosity (4% by mass, 20° C.): 95.0±15.0 CPS], PVA-217EE [PVA content: 94.0% by mass; percent saponification: 88.0±1.0 mol-%; sodium acetate content: 1.0% by mass; volatile content: 5.0% by mass; viscosity (4% by mass, 20° C.): 23.0±3.0 CPS], PVA-217E [PVA content: 94.0% by mass; percent saponification: 88.0±1.0 mol-%; sodium acetate content: 1.0% by mass; volatile content: 5.0% by mass; viscosity (4% by mass, 20° C.): 23.0±3.0 CPS], PVA-220E [PVA content: 94.0% by mass; percent saponification: 88.0±1.0 mol-%; sodium acetate content: 1.0% by mass; volatile content: 5.0% by mass; viscosity (4% by mass, 20° C.): 31.0±4.0 CPS], PVA-224E [PVA content: 94.0% by mass; percent saponification: 88.0±1.0 mol-%; sodium acetate content: 1.0% by mass; volatile content: 5.0% by mass; viscosity (4% by mass, 20° C.): 45.0±5.0 CPS], PVA-403 [PVA content: 94.0% by mass; percent saponification: 80.0±1.5 mol-%; sodium acetate content: 1.0% by mass; volatile content: 5.0% by mass; viscosity (4% by mass, 20° C.): 3.1±0.3 CPS], PVA-405 [PVA content: 94.0% by mass; percent saponification: 81.5±1.5 mol-%; sodium acetate content: 1.0% by mass; volatile content: 5.0% by mass; viscosity (4% by mass, 20° C.): 4.8±0.4 CPS], PVA-420 [PVA content: 94.0% by mass; percent saponification: 79.5±1.5 mol-%, sodium acetate content: 1.0% by mass; volatile content: 5.0% by mass], PVA-613 [PVA content: 94.0% by mass; percent saponification: 93.5±1.0 mol-%; sodium acetate content: 1.0% by mass; volatile content: 5.0% by mass; viscosity (4% by mass, 20° C.): 16.5±2.0 CPS], and L-8 [PVA content: 96.0% by mass; percent saponification: 71.0±1.5 mol-%; sodium acetate content: 1.0% by mass (ash content); volatile content: 3.0% by mass; viscosity (4% by mass, 20° C.): 5.4±0.4 CPS]. (All these products are commercially available from KURARAY CO., LTD.).

The aforementioned measurements were obtained according to JISK-6726-1977.

As the modified polyvinyl alcohols there may be used those disclosed in Koichi Nagano et al, "Poval", Kobunshi Kankokai. Examples of these modified polyvinyl alcohols include cation-modified polyvinyl alcohols, anion-modified polyvinyl alcohols, —SH compound-modified polyvinyl alcohols, alkylthio compound-modified polyvinyl alcohols, and silanol-modified polyvinyl alcohols.

Examples of these modified polyvinyl alcohols (modified PVA) include C polymers such as C-118, C-318, C-318-2A, and C-506 (All these products are commercially available from KURARAY CO., LTD.), HL polymers such as HM-12E and HL-1203 (All these products are commercially available from KURARAY CO., LTD.), HM polymers such as HM-03 and HM-N-03 (All these products are commercially available from KURARAY CO., LTD.), K polymers such as KL-118, KL-N-03, KL-506, KM-118T and KM-618 (All these products are commercially available from KURARAY CO., LTD.), M polymers such as M-115 (All these products are commercially available from KURARAY CO., LTD.), MP polymers such as MP-102, MP-202 and MP-203 (All these products are commercially available from KURARAY CO., LTD.), MPK polymers such as MPK-1, MPK-2, MPK-3, MPK-4, MPK-5 and MPK-6 (All these products are commercially available from KURARAY CO., LTD.), R polymers such as R-1130, R2105 and R-2130 (All these products are commercially available from KURARAY CO., LTD.), and V polymers such as V-2250 (All these products are commercially available from KURARAY CO., LTD.).

A polyvinyl alcohol can be viscosity-adjusted or viscosity-stabilized with a slight amount of a solvent or inorganic salt incorporated in its aqueous solution. For the details of these compounds, reference can be made to the above cited references, Koichi Nagano et al, "Poval", Kobunshi Kankokai, pp. 144-154. As a representative example, boric acid can be incorporated in the aqueous solution of polyvinyl alcohol to enhance the surface conditions of the coat layer to advantage. The amount of boric acid to be incorporated in the aqueous solution of polyvinyl alcohol is preferably from 0.01% to 40% by mass based on the amount of polyvinyl alcohol.

The binder which is preferably used in the present invention is transparent or semitransparent and normally colorless. As such a binder there may be used a natural resin, polymer or copolymer, synthetic resin, polymer or copolymer or other film-forming medium. Examples of these binder materials include rubbers, polyvinyl alcohols, hydroxyethyl celluloses, cellulose acetates, cellulose acetate butyrates, polyvinylpyrrolidones, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinylidene chlorides, polyepoxides, polycarbonates, polyvinyl acetates, polyolefins, cellulose esters and polyamides which are water-soluble.

In the present invention, the water-soluble polymers are preferably polyvinyl alcohols or gelatins, most preferably gelatins.

The amount of the water-soluble polymer to be incorporated in the receiving layer is preferably from 1% to 25% by mass, more preferably from 1% to 10% by mass based on the total amount of the receiving layer.

<Crosslinking Agent>

The aforementioned water-soluble polymer to be incorporated in the receiving layer is preferably partly or entirely crosslinked with a crosslinking agent.

As such a crosslinking agent, there may be incorporated a plurality of amino groups, carboxyl groups or groups reacting with hydroxyl group in the molecule. The crosslinking agent is properly selected depending on the kind of the water-soluble polymer. The kind of the crosslinking agent is not specifically limited. Crosslinking agents as disclosed in the various method described in T. H. James, "THE THEORY OF THE PHOTOGRAPHIC PROCESS FOURTH EDITION" (Macmillan Publishing Co., Inc.), 1977, pp 77-87, U.S. Pat. No. 4,678,739, 41st column, JP-A-59-116655, JP-A-62-245261, and JP-A-61-18942 can be preferably used in the present invention. Any of inorganic compound crosslinking agents (e.g., chrome alum, boric acid, salt thereof) and organic compound crosslinking agents are desirable. Alternatively, a crosslinking agent comprising a mixed aqueous solution containing a chelating agent having a pH value of from 1 to 7 and a zirconium compound described in JP-A-2003-231775 may be used.

Specific examples of the crosslinking agent employable herein include epoxy-based compounds (e.g., diglycidylethyl ether, ethylene glycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds disclosed in JP-A-6-329877 and JP-A-7-309954, Dick Fine EM-60 (trade name; produced by DAINIPPON INK AND CHEMICALS, INCORPORATED), aldehyde-based compounds (e.g., formaldehyde, glyoxal, glutaraldehyde), active halogen-based compounds (e.g., 2,4-dichloro-4-hydroxy-1,3,5-s-triazine, compounds disclosed in U.S. Pat. No. 3,325,287), active vinyl-based compounds (e.g., 1,3,5-trisacryloyl-hexahydro-s-triazine, bisvinylsulfonyl methyl ether, N,N'-ethylene-bis(vinylsulfonyl acetamide)ethane, compounds disclosed in JP-B-53-41220, JP-B-53-57257, JP-B-59-162546 and JP-B-60-80846), mucohalogenic acid compounds (e.g., mucochloric acid), N-carbamoyl pyridinium salt compounds ((1-morpholinocarbonyl-3-pyridinio)methanesulfonate), haloaminium salt compounds (e.g., 1-(1-chloro-1-pyridinomethylene)pyrolidinium, 2-naphthalenesulfonate), N-methylol-based compounds (e.g., dimethylolurea, methylol dimethyl hydantoin), carbodiimide compounds (e.g., isophoronediisocyanate-derived polycarbodiimides disclosed in JP-A-59-187029 and JP-B-5-27450, tetramethyl xylylene diisocyanate-derived carbodiimide compounds disclosed in JP-A-7-330849, multibranched carbodiimide compounds disclosed in JP-A-10-30024, dicyclohexylmethane diisocyanate-derived carbodiimide compounds disclosed in JP-A-2000-7642, Carbodilite V-02, V-02-L2, V-04, V-06, E-01 and E-02 (All these products are commercially available from Nisshinbo Industries, Inc.), oxazoline compounds (e.g., oxazoline compounds disclosed in JP-A-2001-215653, EPOCROS K-1010E, K-1020E, K-1030E, K-2010E, K-2020E, K-2030E, WS-500 and WS-700 (All these products are commercially available from NIPPON SHOKUBAI CO., LTD.), isocyanate compounds (e.g., dispersible isocyanate compounds disclosed in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, Duranate WB40-100, WB40-80D, WT20-100, WT30-100 (All these products are commercially available from Asahi Kasei Corporation), CR-60N (trade name; produced by DAINIPPON INK AND CHEMICALS, INCORPORATED)), polymer hardeners (e.g., compounds disclosed in JP-A-62-234157), boric acid and salt thereof, borax, and aluminum alum.

Preferred examples of the crosslinking agent employable herein include epoxy-based compounds, aldehyde-based compounds, active halogen-based compounds, active vinyl-based compounds, N-carbamoyl pyridinium salt compounds, N-methylol-based compounds (e.g., dimethylolurea, methylol dimethyl hydantoin), carbodiimide compounds, oxazoline compounds, isocyanate compounds, polymer hardeners (e.g., compounds disclosed in JP-A-62-234157), boric acid and salt thereof, borax, and aluminum alum. More desirable among these crosslinking agents are epoxy-based compounds, active halogen-based compounds, active vinyl-based compounds, N-carbamoyl pyridinium salt compounds, N-methylol-based compounds (e.g., dimethylolurea, methylol dimethyl hydantoin), polymer hardeners (e.g., compounds disclosed in JP-A-62-234157), and boric acid. These crosslinking agents may be used singly or in combination of two or more thereof.

The crosslinking agent may be incorporated in the form of mixture with the water-soluble polymer solution or may be incorporated at the last stage during the preparation of the coating solution or shortly before the spreading of the coating solution.

Though depending on the kind of the crosslinking agent used, the water-soluble polymer in the receiving layer is preferably crosslinked in a proportion of from 0.1% to 20% by mass, more preferably from 1% to 10% by mass based on the amount of the water-soluble polymer.

The amount of the crosslinking agent to be used in the present invention depends on the kind of the water-soluble polymer or crosslinking agent but is normally preferably from 0.1 to 50 parts by mass, more preferably from 0.5 to 20 parts by mass, even more preferably from 1 to 10 parts by mass based on 100 parts by mass of the water-soluble polymer in the constituent layer contained.

<Ultraviolet Absorber>

The receiving layer may comprise an ultraviolet absorber incorporated therein to enhance the light-resistance of the heat-sensitive transfer image-receiving sheet. In this case, the ultraviolet absorber can be polymerized so that it can be fixed to the receiving layer, making it possible to prevent itself from being diffused in the ink sheet or sublimated or evaporated when heated.

As the ultraviolet absorber there may be used a compound having various ultraviolet absorber skeletons known widely in the art of data recording. Specific examples of such a compound include compounds having 2-hydroxybenzotriazole type ultraviolet absorber skeleton, 2-hydroxybenzotriazole type ultraviolet absorber skeleton and 2-hydroxybenzophenone type ultraviolet absorber skeleton. From the standpoint of ultraviolet absorbing properties (absorptivity coefficient) and stability, compounds having benzotriazole type and triazine type skeletons are desirable. From the standpoint of polymerization and latex formation, compounds having benzotriazole type and benzophenone type skeletons are desirable. In some detail, ultraviolet absorbers disclosed in JP-A-2004-361936 can be used.

The ultraviolet absorber to be used herein preferably has absorption in the ultraviolet range. Further, the edge of absorption preferably doesn't extend to the visible light range. In some detail, when the ultraviolet absorber is incorporated in the receiving layer to prepare a heat-sensitive transfer image-receiving sheet, the heat-sensitive transfer image-receiving sheet preferably exhibits a reflection density of Abs 0.5 or more at 370 nm, more preferably Abs 0.5 or more at 380 nm. It is also desirable that the reflection density at 400 nm be Abs 0.1 or less. When the reflection density at higher than 400 nm is high, the resulting image is tinged with yellow to disadvantage.

The ultraviolet absorber to be used in the present invention is preferably polymerized. The weight-average molecular weight of the ultraviolet absorber is preferably 10,000 or more, more preferably 100,000 or more. As a method for polymerizing the ultraviolet absorber there is preferably employed a method which comprises grafting the ultraviolet absorber on a polymer. The polymer which is used as a main chain preferably has a polymer skeleton having a poorer dyeing property than the receptive polymer used in combination therewith. The film formed by the polymer preferably has a sufficient strength. The percent grafting of the ultraviolet absorber on the polymer main chain is preferably from 5% to 20% by mass, more preferably from 8% to 15% by mass.

The polymer having an ultraviolet absorber grafted thereon is more preferably latexed. The latexing of the polymer makes it possible to form a receiving layer when an aqueous dispersion-based coating solution is spread and reduce the production cost. As a latexing method there may be used a method disclosed in Japanese Patent No. 3,450,339. As a latexed ultraviolet absorber there may be also used a commercially available ultraviolet absorber such as ULS-700, ULS-1700, ULS-1383MA, ULS-1635MH, XL-7016, ULS-933LP and ULS-935LH (All these products are available from Ipposha Oil Industries Co., Ltd.), and New Coat UVA-1025W, New Coat UVA-204W and New Coat UVA-4512M (All these products are available from Shin-nakamura Chemical Corporation).

In order to latex the polymer having an ultraviolet absorber grafted thereon, it can be mixed with a latex of the aforementioned dyable receptive polymer before being spread to form a receiving layer having an ultraviolet absorber dispersed uniformly therein.

The added amount of the polymer having an ultraviolet absorber grafted thereon or its latex is preferably from 5 to 50 parts by mass, more preferably from 10 to 30 parts by mass based on the amount of the dyable receptive polymer latex constituting the receiving layer.

<Release Agent>

The receiving layer may also comprise a release agent incorporated therein to prevent the heat fusion to the ink sheet during image formation. As such a release agent there may be used a silicone oil or phosphoric acid ester-based plasticizer or fluorine-based compound. A silicone oil is particularly preferably used. As such a silicone oil there is preferably used a modified silicone oil such as epoxy-modified silicone oil, alkyl-modified silicone oil, amino-modified silicone oil, carboxyl-modified silicone oil, alcohol-modified silicone oil, fluorine-modified silicone oil, alkyl aralkyl polyether-modified silicone oil, epoxy-polyether-modified silicone oil and polyether-modified silicone oil. In particular, a reaction product of a vinyl-modified silicone oil and a hydrogen-modified silicone oil is desirable. The amount of the release agent to be incorporated in the receiving layer is preferably from 0.2 to 30 parts by mass based on the amount of the receptive polymer.

The spread of the receiving layer is preferably from 0.5 to 10 g/m$^2$ (The spread will be represented in terms of solid content hereinafter unless otherwise specified). The thickness of the receiving layer is preferably from 1 μm to 20 μm.

(Heat Insulating Layer)

The heat insulating layer acts to protect the support against heat developed during transfer under heating using a thermal head. Further, the heat insulating layer has a high cushioning effect and thus can form a heat-sensitive transfer image-receiving sheet having a high printing sensitivity even when paper is used as a support. The heat insulating layer may be composed of single layer or two or more layers. The heat insulating layer is provided closer to the support than the receiving layer.

In the image-receiving sheet of the present invention, the heat insulating layer contains a hollow polymer.

The hollow polymer in the present invention is a particulate polymer having a closed-cell pore in the interior thereof. Examples of such a hollow polymer include 1) non-foaming type hollow particle having water encapsulated inside a wall formed by a polystyrene, acrylic resin, styrene-acryl resin or the like which allows water in the interior thereof to be evaporated out of the particle to make the interior of the particle hollow when spread and dried, 2) foaming type microballoon having a low boiling liquid such as butane and pentane covered by any or a mixture of polymer of polyvinylidene chloride, polyacrylonitrile, polyacrylic acid and polyacrylic acid ester which allows the low boiling liquid in the interior thereof to foam to make the interior of the particle hollow when spread and heated, and 3) microballoon obtained by previously heating the microballoon (2) so that it foams to form a hollow polymer.

These hollow polymers preferably have a void of from about 20% to 70%. Two or more of these hollow polymers may be used in admixture as necessary. Specific examples of the aforementioned hollow polymer (1) include ROHPAC 1055 (produced by Rohm and Haas Company), Voncoat PP-1000 (produced by DAINIPPON INK AND CHEMICALS, INCORPORATED), SX866 (B) (produced by JSR Co., Ltd.), and Nipol MH5055 (produced by ZEON CORPORATION) (All these products are represented by trade name). Specific examples of the aforementioned hollow polymer (2) include F-30 and F-50 (produced by Matsumoto Yushi-Seiyaku Co., Ltd.) (All these products are represented by trade name). Specific examples of the aforementioned hollow polymer (3) include F-30E (produced by Matsumoto Yushi-Seiyaku Co., Ltd.), and Expancel 461DE, 551DE and 551DE20 (produced by Nippon Ferrite Co., Ltd.) (All these products are represented by trade name). The hollow polymer to be incorporated in the heat insulating layer may be latexed.

The heat insulating layer containing a hollow polymer preferably comprises a water-dispersible resin or water-soluble resin incorporated therein as a binder resin. Examples of the binder resin employable herein include known resins such as acrylic resin, styrene-acryl copolymer, polystyrene resin, polyvinyl alcohol resin, vinyl acetate resin, ethylene-vinyl acetate copolymer, vinyl chloride-vinyl acetate copolymer, styrene-butadiene copolymer, polyvinylidene chloride resin, cellulose derivative, casein, starch and gelatin. These resins may be used singly or in admixture.

The solid content of the hollow polymer in the heat insulating layer is preferably from 5 to 2,000 parts by mass when the solid content of the binder resin is 100 parts by mass. The weight proportion of the solid content of the hollow polymer in the coating solution is preferably from 1% to 70% by mass, more preferably from 10% to 40% by mass. When the weight proportion of the hollow polymer is too small, it may be the case where a sufficient heat insulation cannot be attained. On the other hand, when the weight proportion of the hollow polymer is too great, it may be the case where the bonding force between the hollow polymer particles can be lowered, causing dusting or film exfoliation during treatment.

The particle size of the hollow polymer is preferably from 0.1 μm to 20 μm, more preferably from 0.1 μm to 2 μm, particularly preferably from 0.1 μm to 1 μm. The glass transition temperature (Tg) of the hollow polymer is preferably 70° C. or more, more preferably 100° C. or more.

In the image-receiving sheet of the present invention, the heat insulating layer is free of aqueous dispersion of a resin having no resistance to organic solvent besides the hollow polymer. When the heat insulating layer contains a resin having no resistance to organic solvent (dyable resin), it causes enhanced image bleeding after image transfer to disadvantage. This is presumably because when a dyable resin and a hollow polymer are incorporated in the heat insulating layer, the dye which has been attached to the receiving layer moves through the adjacent heat insulating layer with time after transfer.

The term "having no resistance to organic solvent" as used herein is meant to indicate that the solubility in an organic solvent (e.g., methyl ethyl ketone, ethyl acetate, benzene, toluene, xylene) is 1% by mass or less, preferably 0.5% by mass or less. For example, the aforementioned polymer latex is included in the category of "resins having no resistance to organic solvent".

Further, the heat insulating layer preferably comprises the aforementioned water-soluble polymer incorporated therein. Examples of such a compound which is preferably used herein include those exemplified above with respect to water-soluble polymer.

The amount of the water-soluble polymer to be incorporated in the heat insulating layer is preferably from 1% to 75% by mass, more preferably from 1% to 50% by mass based on the total amount of the heat insulating layer.

The heat insulating layer preferably comprises gelatin incorporated therein. The proportion of gelatin in the coating solution of the heat insulating layer is preferably from 0.5% to 14% by mass, particularly preferably from 1% to 6% by mass. The spread of the aforementioned hollow polymer in the heat insulating layer is preferably from 1 to 100 g/m$^2$, more preferably from 5 to 20 g/m$^2$.

The water-soluble polymer to be incorporated in the heat insulating layer is preferably crosslinked with a crosslinking agent. The crosslinking agent which is preferably used herein and the preferred range of the amount thereof are the same as defined previously.

Though depending on the kind of the crosslinking agent used, the water-soluble polymer in the heat insulating layer is preferably crosslinked in a proportion of from 0.1% to 20% by mass, more preferably from 1% to 10% by mass based on the amount of the water-soluble polymer.

The thickness of the heat insulating layer containing a hollow polymer is preferably from 5 μm to 50 μm, more preferably from 5 μm to 40 μm.

(Underlayer)

An underlayer may be formed between the receiving layer and the heat insulating layer. For example, a whiteness adjusting layer, charge adjusting layer, adhesive layer and primer layer are formed. These layers may have the same configuration as described in Japanese Patent No. 3585599 and Japanese Patent No. 2925244.

(Support)

In the present invention, as the support there is used raw paper having a polyolefin resin layer provided on the both sides thereof or at least one the receiving layer side thereof. Such a support has a water resistance. The use of such a water-resistant support makes it possible to prevent the support from absorbing water content and prevent the change of properties of the receiving layer with time. As the water-resistant support of the present invention there may be used a single-side or double-side coated paper or laminated paper.

In the present invention, as the support there is used raw paper having a polyolefin resin layer provided on the both sides thereof or at least one the receiving layer side thereof. The material of the raw paper is not specifically limited and can be properly selected depending on the purpose. For the details of raw paper to be used in the present invention, reference can be made to "Shasin Kogaku no Kiso Ginenshashin Hen (Introduction to Photooptics Silver Halide Photography Edition)", Society of Photographic Science and Technology of Japan, Corona, 1979, pp. 223-240.

The material of the aforementioned raw paper is not specifically limited. Examples of the raw paper material employable herein include natural pulp selected from the group consisting of conifer pulp and broadleaf tree pulp, synthetic pulp made of plastic material such as polyethylene and polypropylene, and mixture of synthetic pulp and natural pulp.

As the pulp to be used as a material of the aforementioned raw paper there is preferably used a leaved bleached kraft pulp (LBKP) for the purpose of balancing and enhancing the surface smoothness, rigidity and dimensional stability (anti-curling properties) of the raw paper to a sufficient level. Needle bleached kraft pulp (NBKP) or leaved sulfite pulp (LBSP) may be also used. As pulp fiber there is preferably mainly used broadleaf pulp, which originally has a short fiber length. In order to beat pulp, beater or refiner may be used. The pulp slurry obtained by beating pulp may then comprise various additives (e.g., filler, dried paper strength enhancing agent, sizing agent, wet paper strength enhancing agent, fixing agent, pH adjustor, other chemicals) incorporated therein as necessary. For examples of these additives, reference can be made to JP-A-2004-271790, paragraph [0021]-[0025].

The density of the raw paper is preferably 0.9 g/m$^2$ or more, more preferably from 0.95 g/m$^2$ to 1.2 g/m$^2$. The thickness of the raw paper can be properly predetermined depending on the purpose but is normally preferably from 50 μm to 300 μm, more preferably from 100 μm to 250 μm.

The basis weight of the raw paper is not specifically limited and can be predetermined depending on the purpose. The basis weight of the raw paper is preferably from 50 to 250 g/m$^2$, particularly preferably from 100 to 200 g/m$^2$.

The polyolefin resin layer is made of a polyolefin resin such as homopolymer of an α-olefin such as polyethylene and polypropylene and mixture thereof. The molecular weight of these polyolefin resins is not specifically limited so far as they can be subjected to extrusion coating and thus can be predetermined depending on the purpose. In the present invention, a polyolefin having a molecular weight of from 20,000 to 200,000 is preferably used. In the present invention, resins and additives disclosed in JP-A-2004-271790, paragraph [0031]-[0048] can be used depending on the purpose.

The support preferably has a curl adjusting layer, a writing layer and a charge adjusting layer formed on the back side thereof. The spreading of the various layer coating solutions on the back side of the support can be carried out by any ordinary method such as roll coating method, bar coating method, gravure coating method and gravure reverse coating method.

<Coated Paper>

The aforementioned coated paper is obtained by coating a sheet such as raw paper with various resins, rubber latexes or polymer materials on one or both sides thereof. The spread amount of these coating compounds depends on the purpose. Examples of such a coated paper include art paper, cast-coated paper, and Yankee paper.

As the resin to be spread over the surface of the raw paper there is preferably used a thermoplastic resin. Examples of such a thermoplastic resin include the following thermoplastic resin (a) to (h).

(a) Copolymers of polyolefin resin such as polyethylene resin and polypropylene resin or olefin such as ethylene and propylene with other vinyl monomers, acrylic resins, etc.

(b) Thermoplastic resins having ester bond. Examples of such thermoplastic resins include polyester resins obtained by the condensation of dicarboxylic acid component (which may be substituted by sulfonic acid group, carboxyl group or the like) with alcohol component (which may be substituted by hydroxyl group or the like), polyacrylic acid ester resins or polymethacrylic acid ester resins such as polymethyl methacrylate, polybutyl methacrylate, polymethyl acrylate and polybutyl acrylate, polycarbonate resins, polyvinyl acetate resins, styrene acrylate resins, styrene-methacrylic acid ester copolymer resins, and vinyltoluene acrylate resins.

Specific examples of these thermoplastic resins include those disclosed in JP-A-59-101395, JP-A-63-7971, JP-A-63-7972, JP-A-63-7973, and JP-A-60-294862.

Examples of commercially available thermoplastic resins include VYLON 290, VYLON 200, VYLON 280, VYLON 300, VYLON 103, VYLON GK-140 and VYLON GK-130 (produced by (produced by TOYOBO CO., LTD.), Toughton NE-382, Toughton U-5, ATR-2009 and ART-2010 (produced by Kao Corporation), Elitel UE3500, UE3210, XA-8153, KZA-7049 and KZA-1449 (produced by UNITIKA LTD.), Polyestar TP-220 and R-188 (produced by Nippon Synthetic Chemical Industry Ltd.), and various thermoplastic resins of Hi-Ros Series produced by SEIKO PMC CORPORATION).

(c) Polyurethane resins, etc.

(d) Polyamide resins, urea resins, etc.

(e) Polysulfone resins, etc.

(f) Polyvinyl chloride resins, polyvinylidene chloride resins, vinyl chloride-vinyl acetate copolymer resins, vinyl chloride-vinyl propionate copolymer resins, etc.

(g) Polyol resins such as polyvinyl butyral, cellulose resins such as ethyl cellulose resin and cellulose acetate resins, etc.

(h) Polycaprolactone resins, styrene-maleic anhydride resins, polyacrylonitrile resins, polyether resins, epoxy resins, phenolic resins, etc.

The aforementioned thermoplastic resins may be used singly or in combination of two or more thereof.

The thermoplastic resins may optionally comprise a brightening agent, an electrically-conducting agent, a filler, a pigment or dye such as titanium oxide, ultramarine and carbon black or the like incorporated therein.

<Laminated Paper>

The aforementioned laminated paper is obtained by laminating various resins, rubbers, polymer sheets or films on a sheet such as raw paper. Examples of the aforementioned laminating materials employable herein include polyolefins, polyvinyl chlorides, polyethylene terephthalates, polystyrenes, polymethacrylates, polycarbonates, polyimides, and triacetyl celluloses. These resins may be used singly or in combination of two or more thereof.

The aforementioned polyolefin is often normally formed by a low density polyethylene. In order to enhance the heat resistance of the support, a polypropylene, a blend of polypropylene and polyethylene, a high density polyethylene, a blend of high density polyethylene and low density polyethylene or the like is preferably used. From the standpoint of cost, laminatability, etc. in particular, a blend of high density polyethylene and low density polyethylene is most desirable.

In the blend of high density polyethylene and low density polyethylene, the high density polyethylene and the low density are blended at a ratio of from 1/9 to 9/1, preferably from 2/8 to 8/2, more preferably from 3/7 to 7/3 (by weight). In the case where the thermoplastic resin layer is formed on the both sides of the support, the back side of the support is preferably formed by a high density polyethylene or a blend of a high density polyethylene and a low density polyethylene. The molecular weight of the polyethylene is not specifically limited. However, whichever it is a high density polyethylene or low density polyethylene, the polyethylene preferably has a melt index of from 1.0 to 40 g/10 minutes and a good extrudability. In the present invention, a polyolefin having a molecular weight of from 20,000 to 200,000 is preferably used. In the present invention, resins and additives disclosed in JP-A-2004-271790, paragraph [0031] on page 9 to paragraph [0048] on page 11, can be used depending on the purpose.

These sheets or films may be treated to have white reflectivity. Examples of such treatment include a method involving the incorporation of a pigment such as titanium oxide in these sheets or films.

The thickness of the aforementioned support is preferably from 25 μm to 300 μm, more preferably from 50 μm to 260 μm, even more preferably from 75 μm to 220 μm. The rigidity of the support may vary depending on the purpose. As the support for electrophotographic image-receiving sheet for photographic image quality there is preferably used one similar to the support for color silver salt photograph.

The support to be used in the present invention preferably has a Beck smoothness of 10,000 seconds or more and a central line average roughness (Ra) of 0.5 μm or less on the receiving layer side thereof. The support to be used in the present invention more preferably has a Beck smoothness of 15,000 seconds or more and a central line average roughness (Ra) of 0.4 μm or less on the receiving layer side thereof. The support to be used in the present invention preferably has a Beck smoothness of 1,300 seconds or less and a central line average roughness (Ra) of 0.75 μm to 10 μm on the back layer side thereof. In addition, the average distance (S) between local mountain tops is preferably from 30 μm to 75 μm.

(Curl Adjusting Layer)

When the support is exposed as it is, the heat-sensitive transfer image-receiving sheet can be curled due to moisture and heat in the atmosphere. Therefore, the support preferably has a curl adjusting layer formed on the back side thereof. The curl adjusting layer acts to not only prevent the curling of the image-receiving sheet but also protect the image-receiving sheet against water. As the curl adjusting layer there is used a polyethylene laminate, polypropylene laminate or the like. In some detail, the curl adjusting layer can be formed in the same manner as described in JP-A-61-110135, JP-A-6-202295, etc.

(Writing Layer, Charge Adjusting Layer)

The writing layer/charge adjusting layer can be made of an inorganic oxide colloid, ionic polymer or the like. As an antistatic agent there may be used any of cationic antistatic agents such as quaternary ammonium salt and polyamine derivative, anionic antistatic agents such as alkyl phosphate and nonionic antistatic agents such as aliphatic acid ester. In some detail, the writing layer/charge adjusting layer can be formed in the same manner as described in Japanese Patent No. 3,585,585, etc.

(Method for Producing Heat-Sensitive Transfer Image-Receiving Sheet)

The method for producing a heat-sensitive transfer image-receiving sheet of the present invention will be described hereinafter.

The heat-sensitive transfer image-receiving sheet of the present invention can be prepared by spreading the various layer coating solutions by an ordinary method such as roll coating method, bar coating method, gravure coating method and gravure reverse coating method, and then drying the various coat layers.

The heat-sensitive transfer image-receiving sheet of the present can be prepared also by simultaneously spreading the receiving layer coating solution and the heat insulating layer coating solution over a support.

In the case where a multi-layer image-receiving sheet composed of a plurality of layers having different functions (e.g., foam layer, heat insulating layer, interlayer, receiving layer) is formed on the support, a method is known which comprises successively spreading the various layer coating solutions over the support or laminating supports having the respective layer coating solution spread thereon on each other as disclosed in JP-A-2004-106283, JP-A-2004-181888, JP-A-2004-345267, etc. In the art of photography, on the other hand, a method is known which comprises simultaneously spreading a plurality of layer coating solutions to drastically enhance productivity. So-called slide coating method and curtain coating method are known as disclosed in U.S. Pat. Nos. 2,761,791, 2,681,234, 3,508,947, 4,457,256 and 3,993,019, JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, JP-B-49-7050, Edgar B. Gutoff et al, "Coating and Drying Defects: Troubleshooting Operating Problems", John Wiley & Sons, 1995, pp. 101-103, etc.

In the present invention, the aforementioned simultaneous multi-layer coating method can be used to produce a multi-layer image-receiving sheet, making it possible to drastically enhance productivity and reduce image defects.

In the present invention, the plurality of layers to be formed on the support are each composed of a resin as a main component. The coating solutions for forming the various layers each are preferably a water-dispersed latex. The solid content of the resin in latex form in the various layer coating solutions is preferably from 5% to 80%, particularly preferably from 20% to 60%. The average particle size of the resin to be incorporated in the aforementioned water-dispersed latex is preferably 5 μm or less, particularly preferably 1 μm or less. The aforementioned water-dispersed latex may comprise any known additives such as surface active agent, dispersant and binder resin incorporated therein as necessary.

In the present invention, a plurality of laminates which have been formed on a support by a method described in U.S. Pat. No. 2,761,791 are then preferably rapidly solidified. For example, in the case where a multilayer structure is formed by the solidification of resins, the formation of the plurality of laminates on the support is immediately followed by the rise of temperature. In the case where the coating solution contains a binder which gels at low temperature such as gelatin, it is also preferred that the formation of the plurality of layer coating solutions be immediately followed by the drop of temperature.

In the present invention, the spread of the coating solution per one of the layers constituting the multilayer structure is preferably from 1 g/m$^2$ to 50 g/m$^2$. The number of layers constituting the multilayer structure is 2 or more and can be arbitrarily predetermined. The receiving layer is preferably provided as a layer farthest from the support.

(Image Forming Method)

In the method for forming an image using a heat-sensitive transfer image-receiving sheet of the present invention, the ink sheet to be used in combination with the aforementioned heat-sensitive transfer image-receiving sheet of the present invention has a dye layer containing a dispersible transfer dye in a support. Any ink sheet may be used. As method for giving a heat energy during heat transfer there may be any known energizing method. For example, by controlling the recording time using a recording device such as thermal printer (e.g., trade name: Video Printer VY-100, produced by Hitachi Limited), a heat energy of from about 5 to 100 mJ/mm$^2$ can be given to attain the desired purpose sufficiently.

(Use)

The heat-sensitive transfer image-receiving sheet of the present invention can comprise a properly selected support so that it can be applied to various uses such as heat-sensitive transfer image-receiving sheets in a sheet or roll form, cards and sheets for transmission type original which can be subjected to heat transfer recording.

The present invention can be used in printers and copying machines utilizing heat-sensitive transfer recording system.

EXAMPLES

The characteristics of the present invention will be further described in the following examples. The materials, added amounts, proportions, treatment conditions, procedural orders, etc. described hereinafter may be properly changed so far as they fall within the essence of the present invention. Accordingly, the scope of the present invention should not be construed as being limited to the following examples.

Example

Preparation of Support 50 parts by mass of LBKP made of acacia and 50 parts by mass of LBKP made of aspen were each beaten to a Canadian standard freeness of 300 ml using a disc refiner to prepare a pulp slurry.

Subsequently, to the pulp slurry thus obtained were added a cation-modified starch (CAT0304L, produced by NIPPON NSC CO., LTD.), an anionic polyacrylamide (DA4104, produced by SEIKO PMC CORPORATION), an alkyl ketene dimer (Sizepine K, produced by Arakawa Chemical Industries, Ltd.), an epoxylated behenic acid amide and a polyamide polyamine epichlorohydrin (Arafix 100, produced by Arakawa Chemical Industries, Ltd.) in an amount of 1.3%, 0.15%, 0.29%, 0.29% and 0.32%, respectively, based on the amount of the pulp. To the mixture was then added an anti-foaming agent in an amount of 0.12% based on the amount of the pulp, The pulp slurry thus prepared was then subjected to paper making using a wire paper machine. The web thus prepared was then pressed against a drum dryer cylinder on the felt surface thereof with a dryer canvass interposed therebetween so that it was dried. During this drying procedure, the tensile force of the dryer canvass was predetermined to be 1.6 kg/cm. Thereafter, a polyvinyl alcohol (KL-118, produced by KURARAY CO., LTD.) was spread over the both sides of the raw paper at a spread of 1 g/m$^2$ using a size press, dried, and then calendered. During paper making, the basis weight was predetermined to be 157 g/m$^2$. Thus, a raw paper (base paper) having a thickness of 160 μm was obtained.

The raw paper was then subjected to corona discharge treatment on the back side thereof while being allowed to run at a speed of 150 m/min. Thereafter, using a coat hanger type two-layer co-extrusion die, a 10-μm layer comprising 10 parts by mass of a low density polyethylene (density: 0.924 g/m$^3$; MI: 3 g/10 min) and 90 parts by mass of a high density polyethylene (density; 0.966 g/m$^3$; MI: 11 g/10 min) and a 15-μm outermost layer comprising 50 parts by mass of a low density polyethylene (density: 0.922 g/m$^3$; MI: 5 g/10 min) and 50 parts by mass of a high density polyethylene (density: 0.970 g/m$^3$; MI: 20 g/10 min) were melt-extruded over the back side of the raw paper. The raw paper was immediately embossed using a chill roll having a mat surface the central line average roughness (Ra) and cooling temperature of which had been properly adjusted as set forth in Table 1 below to provide a nonglossy resin layer thereon.

Subsequently, the aforementioned raw paper was subjected to corona discharge treatment on the front surface thereof. Using a coat hanger type two-layer co-extrusion die, a 14-μm layer comprising 10 parts by mass of a master batch having 60 parts by mass of TiO2 and 2.4 parts by mass of zinc stearate kneaded in 38 parts by mass of a low density polyethylene (density: 0.920 g/m$^3$; MI: 5 g/10 min), 4 parts by mass of a master batch having a bluish pigment kneaded therein and 86 parts by mass of a low density polyethylene (density: 0.918 g/m$^3$; MI: 8 g/10 min) and 16-μm outermost layer comprising 33 parts by mass of a master batch having 60 parts by mass of $TiO_2$ and 2.4 parts by mass of zinc stearate kneaded in 38 parts by mass of a low density polyethylene (density: 0.920 g/m$^3$; MI: 5 g/10 min), 5 parts by mass of master batch having fluorescent whitening agent kneaded therein and 4 parts by mass of a master batch having a bluish pigment kneaded therein were melt-extruded over the front surface of the raw paper. The raw paper was immediately embossed using a chill roll having a mat surface the central line average roughness (Ra) and cooling temperature of which had been properly adjusted as set forth in Table 1 below to provide a glossy resin layer thereon.

Thus, supports 1 and 2 each comprising a glossy resin layer provided on the front surface of raw paper and a nonglossy resin layer provided on the back surface thereof were obtained.

A polyvinyl alcohol was spread over the surface of the aforementioned raw paper at a spread of 1 g/m$^2$ using a size press, dried, and then calendered to obtain a support 3. A nonglossy resin layer was formed on the back surface of the support 3 in the same manner as the supports 1 and 2.

TABLE 1

| Support No. | Resin coated on raw paper | Beck smoothness of surface of support | Central line average roughness (Ra) of surface of support |
|---|---|---|---|
| Support 1 | Polyethylene | 20,000 seconds or more | 0.2 μm |
| Support 2 | Polyethylene | 6,200 seconds | 0.56 μm |
| Support 3 | PVA | 5,666 seconds | 0.8 μm |

(Preparation of Emulsion A)

An emulsion dispersion was prepared in the following manner. The following compound A-6 was dissolved in a mixture of 42 g of a high boiling solvent (Solv-1 shown below) and 20 ml of ethyl acetate. The solution thus obtained was emulsified and dispersed in 250 g of a 20 wt-% aqueous solution of gelatin containing 1 g of sodium dodecylbenzenesulfonate using a high speed agitated emulsifier (Dissolver). To the dispersion was then added water to prepare 380 g of an emulsion A. During this procedure, the amount of the compound A-6 to be added was adjusted to be 30 mmol in the emulsion A.

A-6

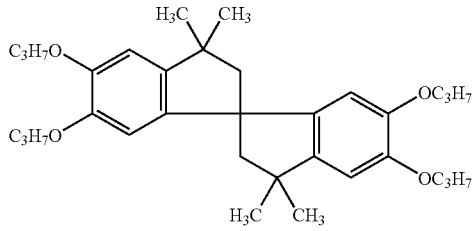

-continued

Solv-1

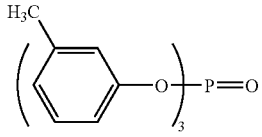

(Preparation of Image-Receiving Sheet)

Samples 101 to 103 were each prepared by simultaneously spreading the various layer coating solutions in such an arrangement that an undercoating layer 1, an undercoating layer 2 and an image-receiving layer 3 were formed in this order on a support. During the simultaneous multi-layer coating process, the spread of the undercoating layers 1 and 2 were each adjusted to be 11 ml/m$^2$ and the spread of the receiving layer was adjusted to be 18 ml/m$^2$. Samples 104 to 106 were each prepared by simultaneously spreading the various layer coating solutions in such an arrangement that an undercoating layer 1, an undercoating layer 2, a heat insulating layer and an image-receiving layer 4 were formed in this order on a support. The spread of the heat insulating layer was adjusted to be 45 ml/m$^2$. The spread of the other layers were adjusted to be the same as in Samples 101 to 103. The formulation of the various coating solutions will be given below.

<Coating Solution for Undercoating Layer 1>

Aqueous solution obtained by adding 1% of sodium dodecylbenzenesulfonate to a 3% aqueous solution of gelatin and adjusting pH thereof to 8 with NaOH <Coating Solution for Undercoating Layer 2>

| | |
|---|---|
| Styrenebutane diene latex (SR103, produced by L&L Products of Japan Inc.) | 60 parts by mass |
| 6% aqueous solution of PVA | 40 parts by mass |
| NaOH | to make pH8 |

<Coating Solution for Heat Insulating Layer>

| | |
|---|---|
| Hollow polymer latex (produced by ZEON CORPORATION) | 60 parts by mass |
| 10% aqueous solution of gelatin | 20 parts by mass |
| Emulsion A shown above | 20 parts by mass |
| NaOH | to make pH8 |

<Coating Solution for Receiving Layer>

| | |
|---|---|
| Polymer latex of the kind set forth in Table 1 | 70 parts by mass |
| 10% aqueous solution of gelatin | 10 parts by mass |
| Emulsion A shown above | 10 parts by mass |
| Microcrystalline wax (EMUSTAR-42X, produced by NIPPON SEIRO CO., LTD) | 5 parts by mass |
| Water | 5 parts by mass |
| NaOH | to make pH8 |

Test Examples

Preparation of Ink Sheet

A polyester film having a thickness of 6.0 μm (Lumirror (trade name), produced by Toray Industries, Ltd.) was used as a support. A heat-resistant slip layer (thickness: 1 μm) was formed on the back surface of the film. A yellow coating solution, a magenta coating solution and a cyan coating solution having the following formulations were each monochromatically spread over the front surface of the film (dried spread: 1 g/m$^2$) to prepare an ink sheet.

<Yellow Coating Solution>

| | |
|---|---|
| Dye (MACROLEX YELLOW 6G (trade name), produced by Bayer Japan Co., Ltd.) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |

<Magenta Coating Solution>

| | |
|---|---|
| Magenta dye (Disperse Red 60) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |

<Cyan Coating Solution>

| | |
|---|---|
| Cyan dye (Solvent Blue 63) | 5.5 parts by mass |
| Polyvinyl butyral resin (S-LEX BX-1 (trade name), produced by SEKISUI CHEMICAL CO., LTD.) | 4.5 parts by mass |
| Methyl ethyl ketone/toluene (weight ratio: 1/1) | 90 parts by mass |

(Image Formation)

The aforementioned ink sheet and the aforementioned Samples 101 to 106 were each then worked so as to be loaded in a Type DPB1500 sublimation type printer (produced by Nidec Copal Corporation). With the ink sheet and these samples loaded in the printer, images were then outputted in a high speed print mode under the conditions such that a gray gradation ranging from lowest density to highest density can be obtained. During the image forming process, 13 seconds were required to output one sheet of L size print.

(Evaluation)

(1) Evaluation of Dmax

The black image obtained under the aforementioned conditions was measured for visual density using a photographic densitometer produced by X-Rite Incorporated.

(2) Evaluation of Image Quality

An image unevenness (low density image unevenness) having a size of from 0.1 mm to 1 mm was observed in an area having a visual density close to 0.2 among the gray gradation obtained by Type DPB1500 sublimation type printer described above. The degree of image unevenness was visually evaluated.

When the image unevenness was the same as seen in color print made on commercially available silver salt color paper, it was then evaluated to be acceptable.

These evaluation results are collectively set forth in Table 2 below.

TABLE 2

| Sample No. | Support No. | Resin coated on raw paper surface | Heat Insulating layer containing hollow polymer Incorporated? | Dmax | Low density image unevenness | Remarks |
|---|---|---|---|---|---|---|
| 101 | Support 1 | Polyethylene | No | 1.65 | Acceptable | Comparative |
| 102 | Support 2 | Polyethylene | No | 1.55 | Acceptable | Comparative |
| 103 | Support 3 | PVA | No | 1.52 | Acceptable | Comparative |
| 104 | Support 1 | Polyethylene | Yes | 2.09 | Acceptable | Inventive |
| 105 | Support 2 | Polyethylene | Yes | 2.05 | Acceptable | Inventive |
| 106 | Support 3 | PVA | Yes | 2.01 | Not tolerable | Comparative |

As can be seen in the results shown above, all the inventive samples show a high Dmax and little image unevenness in low density area.

The heat-sensitive transfer image-receiving sheet of the present invention is characterized by a high transfer density and little image defects. In accordance with the present invention, a heat-sensitive transfer image-receiving sheet capable of forming a glossy image having a high quality and a heat-sensitive transfer image-receiving sheet which shows little image deterioration after transfer can be easily provided. Further, the heat-sensitive transfer image-receiving sheet of the present invention can be prepared at a reduced cost. Accordingly, the heat-sensitive transfer image-receiving sheet of the present invention has a high industrial applicability.

While the present invention has been described in detail and with reference to specific embodiments thereof, it will be apparent to one skilled in the art that various changes and modifications can be made therein without departing from the spirit and scope thereof.

The present disclosure relates to the subject matter contained in Japanese Patent Application No. 051696/2006 filed on Feb. 28, 2006, which is expressly incorporated herein by reference in its entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A heat-sensitive transfer image-receiving sheet comprising at least one heat insulating layer containing hollow polymer particles, and at least one receiving layer containing a polymer latex on a support in this order, wherein the hollow polymer particles are non-foaming type hollow polymer latex particles of polystyrene, acrylic resin or styrene-acrylic resin having an average particle size of from 0.1 to 2 μm;

the heat insulating layer also contains gelatin as a binder;

the support comprises a coated raw paper and polyethylene resin layers provided on both sides of the raw paper;

wherein the coated raw paper is prepared by coating polyvinyl alcohol on both sides of a raw paper, and drying and calendering the coated paper; and the polyethylene resin layer formed on the side of the support opposite to the insulating layer contains high density polyethylene and low density polyethylene in a weight ratio of from 2/8 to 8/2.

2. The heat-sensitive transfer image-receiving sheet according to claim 1, wherein the support exhibits a Beck smoothness of 10,000 seconds or more and a central line average roughness (Ra) of 0.5 gm or less on the receiving layer side thereof.

3. The heat-sensitive transfer image-receiving sheet according to claim 1, wherein the raw paper has a basis weight of from 50 to 250 g/m2.

4. The heat-sensitive transfer image-receiving sheet according to claim 1, wherein each of the high density polyethylene and the low density polyethylene has a melt index of from 1.0 to 40 g/10 minutes.

5. The heat-sensitive transfer image-receiving sheet according to claim 1, wherein the support has a thickness of from 25 μm to 300 μm.

6. The heat-sensitive transfer image-receiving sheet according to claim 1, wherein the receiving layer and the heat insulating layer are formed by a simultaneous multi-layer coating method.

7. The heat-sensitive transfer image-receiving sheet according to claim 1, wherein the receiving layer contains gelatin.

8. The heat-sensitive transfer image-receiving sheet according to claim 1, further comprising an undercoating layer between the insulating layer and the support, wherein the undercoating layer is in contact with the insulating layer, and the undercoating layer and any layers coated on the undercoating layer contain a latex.

9. The heat-sensitive transfer image-receiving sheet according to claim 1, further comprising an undercoating layer between the insulating layer and the support, wherein the undercoating layer is in contact with the insulating layer, the undercoating layer and any layers coated on the undercoating layer contain a latex, and the undercoating layer contains styrene-butadiene latex.

10. The heat-sensitive transfer image-receiving sheet according to claim 1, further comprising an undercoating layer between the insulating layer and the support, wherein the undercoating layer is in contact with the insulating layer, the undercoating layer and any layers coated on the undercoating layer contain a latex, and the undercoating layer contains styrene-butadiene latex and polyvinyl alcohol.

11. The heat-sensitive transfer image-receiving sheet according to claim 1, further comprising at least two undercoating layers between the insulating layer and the support, wherein one of the undercoating layers is in contact with the insulating layer, and the undercoating layer in contact with the insulating layer and any layers coated thereon contain a latex.

12. The heat-sensitive transfer image-receiving sheet according to claim 1, further comprising at least two undercoating layers between the insulating layer and the support, wherein one of the undercoating layers is in contact with the insulating layer, the undercoating layer in contact with the insulating layer and any layers coated thereon contain a latex, and the undercoating layer in contact with the insulating layer contains styrene-butadiene latex.

13. The heat-sensitive transfer image-receiving sheet according to claim 1, further comprising at least two undercoating layers between the insulating layer and the support, wherein one of the undercoating layers is in contact with the insulating layer, the undercoating layer in contact with the insulating layer and any layers coated thereon contain a latex, and the undercoating layer in contact with the insulating layer contains styrene-butadiene latex and polyvinyl alcohol.

14. The heat-sensitive transfer image-receiving sheet according to claim 1, wherein the receiving layer contains a microcrystalline wax as a release agent.

15. The heat-sensitive transfer image-receiving sheet according to claim 1, wherein the gelatin contained in the insulating layer is crosslinked partly or entirely.

* * * * *